US006083352A

United States Patent [19]

Snellman et al.

[11] Patent Number: 6,083,352

[45] Date of Patent: Jul. 4, 2000

[54] SHOE PRESS

[75] Inventors: Jorma Snellman, Jyväskylä, Finland; Erik Brox, Forshaga; Lars Gustavsson, Karlstad, both of Sweden; Juha Mikko Tapani Kivimaa, Charlotte, N.C.

[73] Assignee: Valmet Corporation, Finland

[21] Appl. No.: 09/183,924

[22] Filed: Oct. 30, 1998

Related U.S. Application Data

[60] Provisional application No. 60/080,953, Apr. 7, 1998.

[30] Foreign Application Priority Data

Jan. 30, 1998 [SE] Sweden ..... 9800262-9

[51] Int. Cl.[7] ..... D21F 3/00; D21H 11/00; B29C 43/46

[52] U.S. Cl. ..... 162/358.3; 162/358.4; 162/361; 492/7; 100/153; 100/162 B

[58] Field of Search ..... 162/358.3, 358.4, 162/358.5, 361; 492/7; 72/241.6; 100/153, 162 B

[56] References Cited

U.S. PATENT DOCUMENTS

| | | |
|---|---|---|
| 3,846,883 | 11/1974 | Biondetti . |
| 4,228,571 | 10/1980 | Biondetti . |
| 4,530,227 | 7/1985 | Schlatter et al. . |
| 4,576,682 | 3/1986 | Laapotti . |
| 4,643,802 | 2/1987 | Schiel . |
| 4,651,628 | 3/1987 | Zag et al. . |
| 4,713,147 | 12/1987 | Saarinen . |
| 4,917,768 | 4/1990 | Ilmarinen . |
| 5,018,258 | 5/1991 | Niskanen . |
| 5,223,100 | 6/1993 | Schiel et al. . |
| 5,389,205 | 2/1995 | Pajula et al. . |
| 5,587,051 | 12/1996 | Ostermayer et al. . |
| 5,702,337 | 12/1997 | Renn et al. . |

FOREIGN PATENT DOCUMENTS

| | | |
|---|---|---|
| 2 173 890 | 10/1996 | Canada . |
| 4133562A1 | 4/1993 | Germany . |

OTHER PUBLICATIONS

W. Schuwerk, "NipcoFlex Shoe Presses for Writings and Printings—Concepts and Initial Operating Experience", Paper Technology, Dec. 5–6, 1995, pp. 1–11.

*Primary Examiner*—Peter Chin
*Assistant Examiner*—Dianne A. Walls
*Attorney, Agent, or Firm*—Alston & Bird, LLP

[57] ABSTRACT

A shoe press for applying pressure to a moving web of paper or the like includes a press shoe extending along a full width of the web being carried through a nip defined between the shoe and a backing member, a support for the shoe, and a plurality of articulated hydraulic loading cylinders arranged between the support and the shoe for urging the shoe toward the backing member to apply pressure to the web. Each loading cylinder includes a single piston and first and second cylinders attached to the shoe and to the support, respectively. The opposite end portions of the piston are slidably received within the cylinders so as to define working chambers in the cylinders which are pressurizable by hydraulic fluid for urging the two cylinders away from each other. The piston engages the cylinders at seals which enable the piston to pivot with respect to both cylinders about axes parallel to and perpendicular to the machine direction so as to enable the loading cylinders to accommodate deformations and thermal expansion of the shoe in the cross-machine direction and to allow the shoe to pivot about an axis perpendicular to the machine direction.

29 Claims, 8 Drawing Sheets

SHOE PRESS

CROSS-REFERENCE TO RELATED APPLICATION

This application claims priority to U.S. Provisional Patent Application Serial No. 60/080,953 filed Apr. 7, 1998.

FIELD OF THE INVENTION

The present invention relates to shoe presses for applying pressure to a running web of paper, paperboard, or the like. More particularly, the present invention relates to a shoe press of the type having a support which supports a press shoe adjacent to a counter roll or other backing member such that the press shoe and backing member form an extended nip therebetween, and having a hydraulic device for urging the press shoe toward the backing member to apply pressure to the web running through the nip.

BACKGROUND OF THE INVENTION

In a papermaking machine, a wet web of paper or the like from the forming section of the machine is typically carried through the nip of a shoe press of the above-described type, where the web is pressed between two layers of absorbent felt or the like for wicking moisture from the web. Such shoe presses can also be used for calendering the web downstream of the forming section.

Various shoe presses of the above-described type have been proposed. For example, U.S. Pat. No. 4,917,768, which is commonly owned with the present application, discloses a shoe press in which the press shoe is carried on the support by tubular sleeves rigidly affixed to and spaced apart on the support along the cross-machine direction, the sleeves being slidably received within cylindrical recesses in the press shoe to permit the press shoe to be moved toward and away from a counter roll for varying the nip pressure. The shoe press includes hydraulic jacks upstream and downstream of the sleeves for urging the press shoe toward the counter roll and for pivoting the shoe about a cross-machine axis so as to vary the nip pressure in the machine direction. The sleeves fit somewhat loosely in the recesses in the shoe and a resilient seal encircles each sleeve for sealing the interface between the sleeve and recess. Accordingly, the press shoe is capable of pivoting relative to the support for varying the nip pressure in the machine direction.

One of the difficulties encountered in shoe presses is thermal expansion of the shoe from frictional heating of the shoe by the belt that carries the paper web through the press, as well as from hot hydraulic fluid which is circulated through the shoe for various purposes. Thermal expansion of the shoe causes elongation in the cross-machine direction. In the shoe press disclosed in the '768 patent, such thermal expansion of the shoe causes the sleeves to be placed under bending stresses, which is undesirable. Moreover, although the shoe in the '768 patent is slidable on the pistons of the hydraulic jacks, the large normal forces exerted on the shoe by the pistons during operation of the shoe press result in substantial frictional forces on the pistons when the shoe expands through thermal action. Consequently, the pistons are placed in bending within the cylinders of the hydraulic jacks, and such bending can lead to malfunction of the jacks, particularly for the cylinders toward the outer ends of the shoe farthest from the centerline where thermal expansion results in relatively greater translation of the shoe relative to the support and pistons. Bending of the pistons is undesirable from the standpoint of wear on the pistons, cylinders, and seals, and can also interfere with proper functioning of the press. Additionally, thermal expansion of the shoe can cause leakage of hydraulic fluid when the seals are excessively deformed.

In part because of the problems noted above with respect to the bending of the sleeves, the assignee of the present application developed an alternative shoe press similar to that disclosed in the '768 patent but eliminating the sleeves. However, this shoe press still suffered from the problems of bending of the pistons of the hydraulic jacks as noted above. Additionally, because the shoe was freely supported on the pistons of the hydraulic jacks, the shoe was free to take a variety of positions relative to the support beam and counter roll. More particularly, the shoe could become slanted, wherein one end of the shoe was displaced towards the downstream end of the machine and the opposite end was displaced toward the upstream end of the machine. Because of frictional forces between the shoe and the pistons, once the shoe became slanted it was difficult for the shoe to readjust into a correct position.

SUMMARY OF THE INVENTION

The present invention provides a shoe press capable of tolerating relatively large cross-machine elongations and other deformations of the press shoe without the problems associated with some prior shoe presses noted above. In one embodiment of the invention, the sloe press includes a press shoe that extends in a cross-machine direction along the full width of a web being carried through the press, and a plurality of articulated hydraulic loading cylinders spaced apart along the shoe in the cross-machine direction and supported by a support. The loading cylinders define working chambers that are pressurizable by hydraulic fluid so as to cause the loading cylinders to urge the press shoe away from the support and toward a counter roll or other backing member for applying pressure to the web being carried through the nip defined between the shoe and the backing member. Each loading cylinder comprises a piston member disposed within a cylinder member. One of the piston and cylinder members comprises a two-piece member having a first member fixed relative to the press shoe and a second member fixed relative to the support, while the other of the piston and cylinder members comprises a coupler. For example, in one preferred embodiment, the two-piece member comprises first and second cylinders and the coupler comprises a piston which is slidably received within both of the cylinders. In an alternative preferred embodiment, the two-piece member comprises first and second pistons and the coupler comprises a cylinder which surrounds both of the pistons.

The coupler sealingly engages both the first and second members such that the first member is urged away from the second member in a loading direction by pressurization of the working chamber to cause the press shoe to be urged toward the backing member. In order to enable the loading cylinders to accommodate cross-machine elongation of the press shoe, each coupler engages the respective first and second members at seals which enable the coupler to pivot relative to the first and second members about axes parallel to the machine direction. Thus, the press shoe is free to thermally expand in the cross-machine direction without causing bending of any piston and/or cylinder members of the loading cylinders.

In accordance with a preferred embodiment of the invention, each loading cylinder includes first and second cylinders and a single piston. A first working chamber is defined by the first cylinder and a first end of the piston which is slidably received therein, and a second working chamber is defined by the second cylinder and a second end of the piston which is slidably received therein. Each working chamber is pressurizable with hydraulic fluid for urging the press shoe in the loading direction away from the support and toward the backing member. Preferably, the piston includes a passage connecting the two working chambers to enable fluid communication therebetween. One of the press shoe and the support includes a supply passage for supplying pressurized hydraulic fluid into one of the first and second working chambers. Advantageously, the supply passage is in the support for supplying fluid to the second working chamber.

Various configurations of cylinders and pistons are possible within the scope of the invention. In accordance with one preferred embodiment, the piston comprises a tubular member having generally cylindrical inner and outer surfaces. Each of the first and second ends of the piston has an annular flange which projects radially outward beyond the cylindrical outer surface of the piston, and each flange supports a resilient compressible seal. The radial dimensions of the flanges are sufficiently large in relation to their axial extent and to the axial lengths of the portions of the piston residing within the cylinders, that a substantial degree of pivotal movement of the piston is enabled relative to the cylinders about axes parallel to the machine direction. Preferably, the second cylinder includes a stop member which extends radially inward to a diameter smaller than the flange on the second end of the piston so as to limit movement of the piston in the loading direction away from the support.

In accordance with yet another preferred embodiment of the invention, a hydraulically operated shoe-retracting actuator is disposed within the interior of the piston of at least one of the loading cylinders. Either the support or the shoe includes a passage adapted to supply hydraulic fluid to the shoe-retracting actuator, the actuator being operable by hydraulic pressure to retract the shoe away from the counter roll and toward the support. The shoe-retracting actuator preferably comprises an actuator piston attached to the support and extending into the interior of the piston of the loading cylinder, and an actuator cylinder sealingly surrounding the actuator piston so as to define a chamber pressurizable by hydraulic fluid to urge the actuator cylinder toward the support. The actuator cylinder engages a projection affixed to the press shoe such that actuation of the shoe-retracting actuator causes the press shoe to be urged toward the support.

It will thus be appreciated that the invention provides a shoe press in which the press shoe is supported so as to be freely movable in the cross-machine direction without wear, bending, or other undesirable consequences to the loading cylinders. The loading cylinders also can accommodate deformations or translations of the press shoe in the machine direction, as well as pivoting of the press shoe about an axis parallel to the cross-machine direction. Additionally, the articulated loading cylinders prevent the press shoe from assuming a slanted position.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE DRAWINGS

Figure 1:
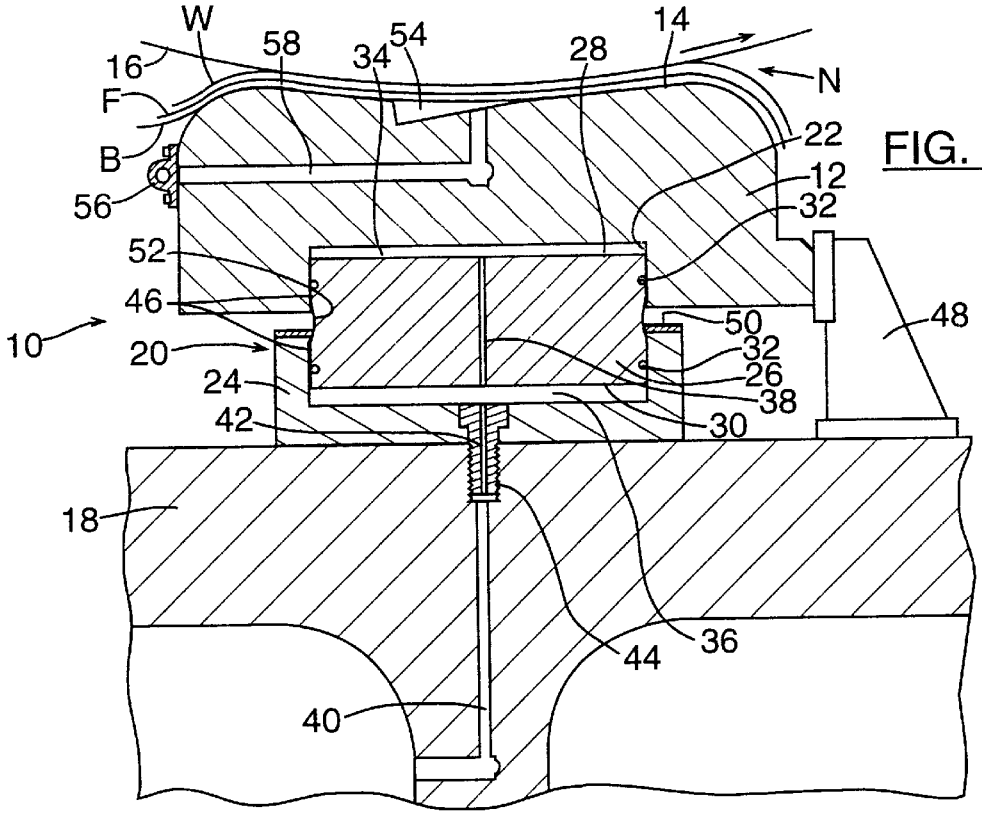
FIG. 1 is a cross-sectional view of a shoe press in accordance with a first preferred embodiment of the invention, taken on a plane parallel to the machine direction through an axis of one of the loading cylinders.

The invention is now explained by reference to certain preferred embodiments thereof as shown in the drawings. It will be understood, however, that the invention is not limited to the embodiments shown and described herein.

Figure 2:
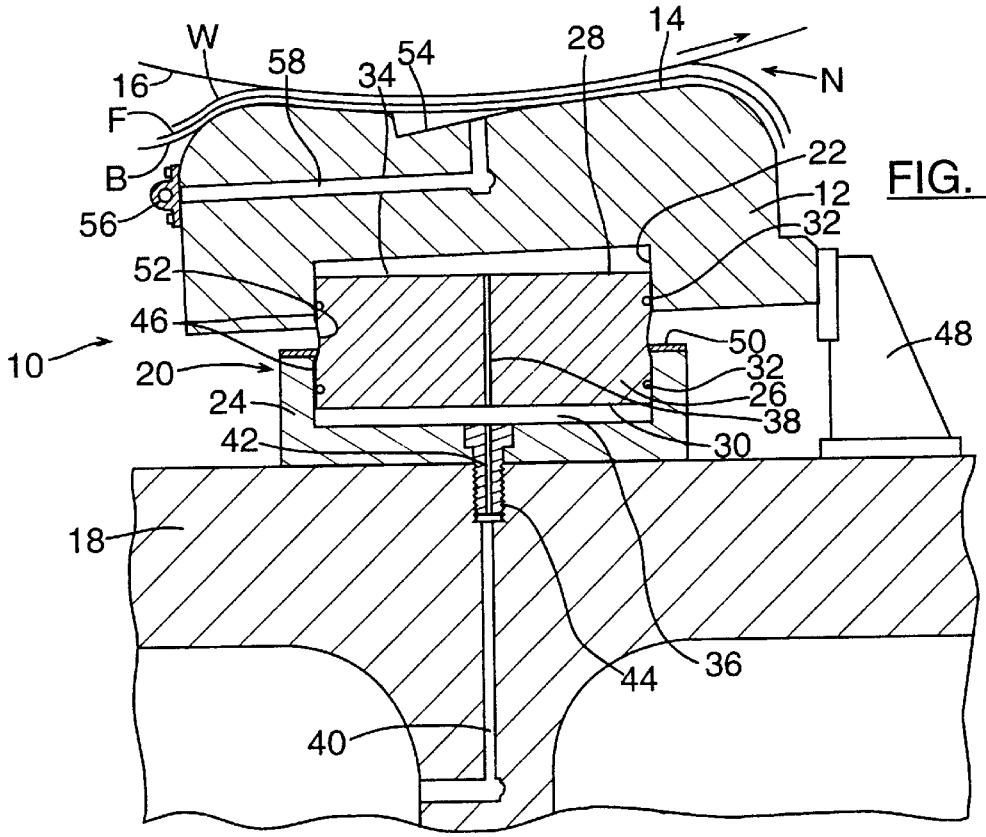
FIG. 2 is a view similar to FIG. 1, showing the press shoe pivoted relative to the support about an axis parallel to the cross-machine direction.
Figure 3:
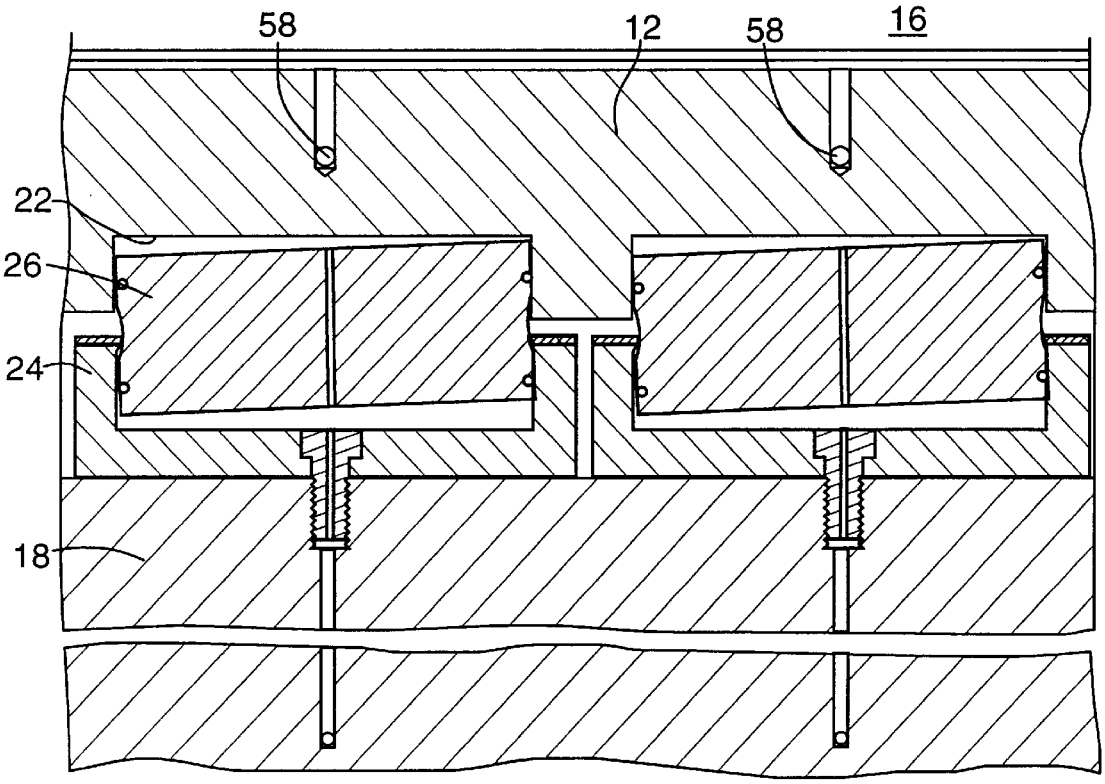
FIG. 3 is a cross-sectional view of the press shoe of FIG. 1 taken on a plane parallel to the cross-machine direction through the axes of the loading cylinders.

With reference to FIGS. 1–3, a shoe press 10 in accordance with a first preferred embodiment of the invention is illustrated. The shoe press 10 includes a press shoe 12 which is configured on one surface 14 thereof so as to be generally complementary in contour to a backing member such as the counter roll 16 depicted in the drawings. The shoe 12 and counter roll 16 define a nip N through which a moving web W of paper, paperboard, or the like is carried. The web W typically is carried by an endless belt B and is in contact with one or more press felts F or other absorbent material. The shoe press 10 can be used in the press section and/or calender of a papermaking machine, and can also be used as a pre-press in a forming section of a papermaking machine. It will be recognized that when used in a calender or forming section of a machine, the web W would be passed through the device 10 without any absorbent felt.

The shoe press 10 further includes a support 18. The shoe 12 and the support 18 extend lengthwise in the cross-machine direction (as best seen in FIG. 3) along at least the full width of the web W, and preferably the shoe 12 is slightly wider than the web W. The shoe 12 is supported by the support 18 and is urged toward the backing member 16 for applying pressure to the web W by a plurality of articulated hydraulic loading cylinders 20 arranged between the support 18 and the shoe 12 and spaced apart in the cross-machine direction.

Each loading cylinder 20 comprises a piston member and a cylinder member, one of the members being formed in two parts and the other member forming a coupler between the two parts. More particularly, the two-piece member of the loading cylinder 20 includes a first cylinder 22 that is fixed relative to the shoe 12, a second cylinder 24 that is fixed relative to the support 18, and a piston 26 slidably received with each of the cylinders. In the embodiment depicted in FIGS. 1–3, the first cylinder 22 comprises a recess formed in the shoe 12. The second cylinder 24 is a member formed separately from the support 18 and affixed thereto.

A first end 28 of the piston 26 is slidably received within the first cylinder 22 and a second end 30 of the piston is slidably received within the second cylinder 24. A resilient compressible seal 32 surrounds each end of the piston 26 for sealing against the inner surfaces of the cylinders. A first working chamber 34 is thus defined between the first end 28 of the piston 26 and the side and end walls of the first cylinder 22, and a second working chamber 36 is defined between the second end 30 of the piston and the side and end walls of the second cylinder 24. The piston 26 includes a passage 38 connecting the first and second working chambers so that there is fluid communication between them. The support 18 includes a supply passage 40 for supplying pressurized hydraulic fluid into the second working chamber 36. The supply passage 40 connects with a bore 42 in a fastener 44 which is used for securing the second cylinder 24 to the support 18. Thus, pressurized fluid supplied through the passage 40 into the second working chamber 36 causes the first and second cylinders 22 and 24 to be urged away from each other. The shoe 12 is thus urged toward the backing member 16. The first working chamber 34 is also pressurized substantially equal to the second chamber by virtue of the passage 38 in the piston 26. Where the first and second ends 28 and 30 of the piston are essentially equal as shown in FIGS. 1–3, the net axial force on the piston 26 is thus nearly zero.

The piston 26 preferably includes spherical surfaces 46 which confront the inner surfaces of the cylinders 22 and 24. The resilient compressible seals 32 extend radially outward of the spherical surfaces 46 into contact with the inner surfaces of the cylinders. Accordingly, the piston 26 is able to pivot about axes parallel to the machine and cross-machine directions relative to both of the cylinders while maintaining proper sealing of the working chambers. FIG. 2 depicts the shoe 12 and first cylinder 22 pivoted relative to the piston 26 about an axis parallel to the cross-machine direction. Although only one of the loading cylinders 20 is depicted in FIG. 2, it will be understood that the pistons of all of the cylinders 20 along the cross-machine direction can pivot relative to the shoe 12 so that the shoe can pivot as a unit relative to the support 18. FIG. 3 depicts a pair of the loading cylinders 20 in which the pistons 26 have been pivoted relative to both cylinders 22 and 24 about axes parallel to the machine direction as a result of the shoe 12 being translated in the cross-machine direction (to the left in FIG. 3). Thus, the loading cylinders 20 allow substantial freedom of movement of the shoe 12 in terms of both pivotal and translational movements.

Because the shoe 12 is capable of translating in the machine direction relative to the support 18, the shoe press includes a guide rail or stop 48 for limiting the extent to which the shoe can move. The loading cylinders 20 also include stop rings 50 for limiting the movement of the pistons 26 in the loading direction away from the support 18. The stop rings 50 are affixed to the outermost ends of the second cylinders 24 and extend radially inward to a diameter smaller than that of the spherical surfaces 46 on the second ends of the pistons 26. Each piston 26 has an axially extending portion 52 of reduced diameter located about midway along the axial length of the piston between the spherical surfaces 46 at each end. The reduced diameter portion 52 is smaller in diameter than the inner surface of the stop ring 50 over a sufficient axial length of the piston 26 so that the piston is capable of some range of axial movement within the second cylinder 24.

The shoe press 10 also includes hydrostatic compartments 54 in the surface 14 facing the counter roll 16 for lubrication purposes, as well known in the art. The compartments 54 are supplied with hydraulic fluid by a pipe 56 attached to the shoe 12 and communicating with the compartments via passages 58 in the shoe.

Figure 4:
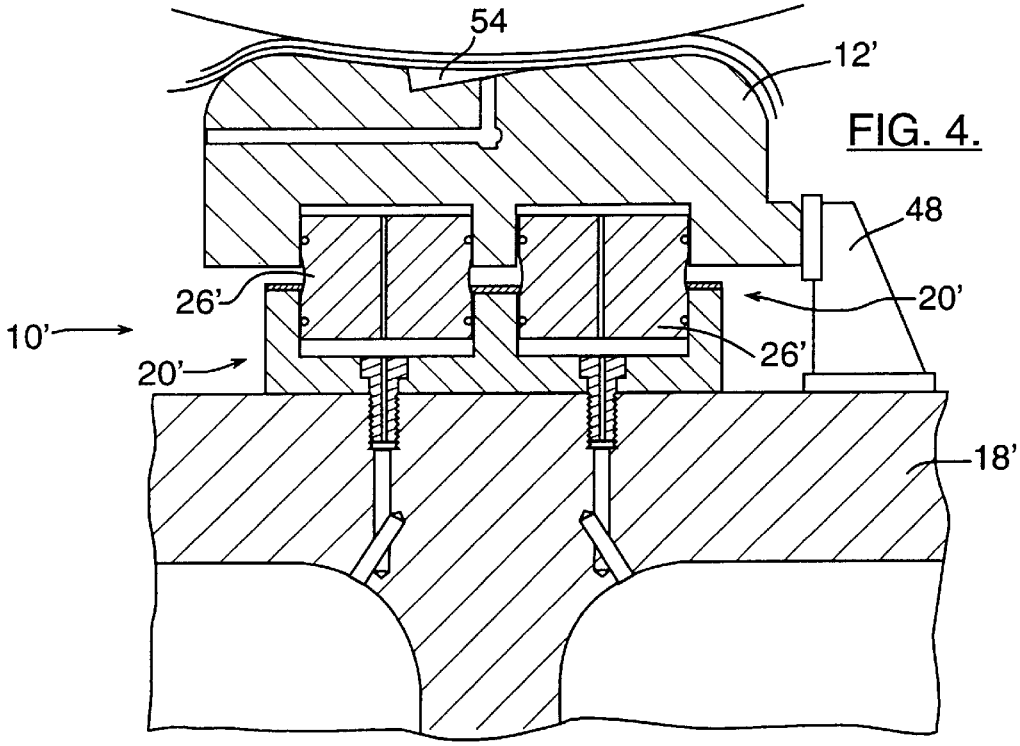
FIG. 4 is a cross-sectional view similar to FIG. 1, showing a second preferred embodiment of the invention having two rows of loading cylinders spaced apart in the machine direction for imparting pivotal motion to the press shoe to vary the nip pressure in the machine direction.

FIG. 4 depicts a second preferred embodiment of the invention in the form of a shoe press 10' having two rows of loading cylinders 20' generally as described above (the primary differences being the smaller diameters of the loading cylinders 20'), the two rows being spaced apart in the machine direction for varying the nip pressure in the machine direction.

Figure 5:
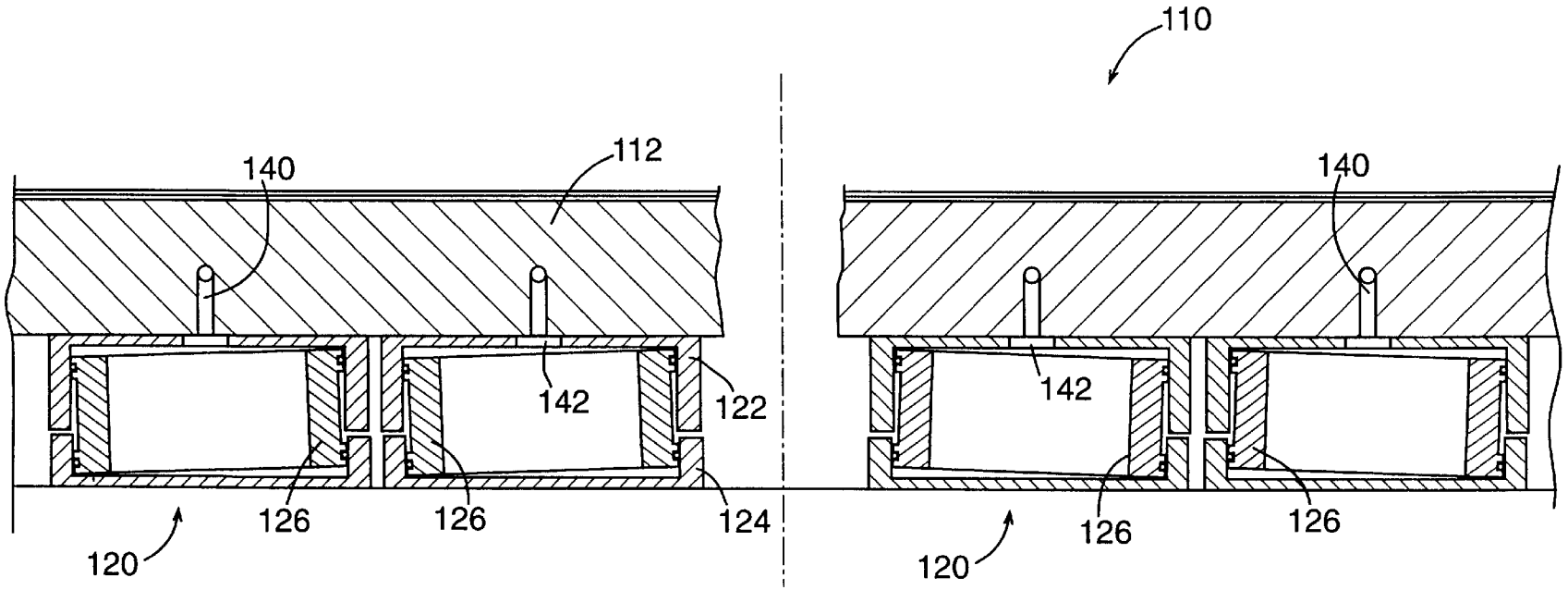
FIG. 5 is a view similar to FIG. 3, showing a third preferred embodiment of the invention.

FIG. 5 illustrates a third preferred embodiment of the invention. The shoe press 110 of FIG. 5 includes loading cylinders 120 in which the first cylinders 122 are formed not as recesses in the shoe 112 but rather as separate members, similar to the second cylinders 124. Hydraulic fluid is supplied to the loading cylinders 120 through passages 140 in the shoe 112 and through openings 142 in the first cylinders 122. The passages 140 may be supplied with fluid via a pipe (not shown) attached to the shoe 112 in a manner similar to that depicted in FIGS. 1–2. It will also be noted that FIG. 5 illustrates the type of deformation of the shoe 112 caused by thermal expansion, whereby the two loading cylinders 120 on the left-hand side which are located on one side of the machine axial centerline have their pistons 126 pivoted in one direction about axes parallel to the machine direction, and the two loading cylinders 120 on the right-hand side of the centerline have their pistons 126 pivoted in the opposite direction about axes parallel to the machine direction. It will also be noted that the pistons 126 are hollow tubular members, as opposed to the generally solid pistons 26 and 26' of the presses shown in FIGS. 1–4. This construction of the pistons 126 results in savings in material relative to the solid-type pistons.

Figure 6:
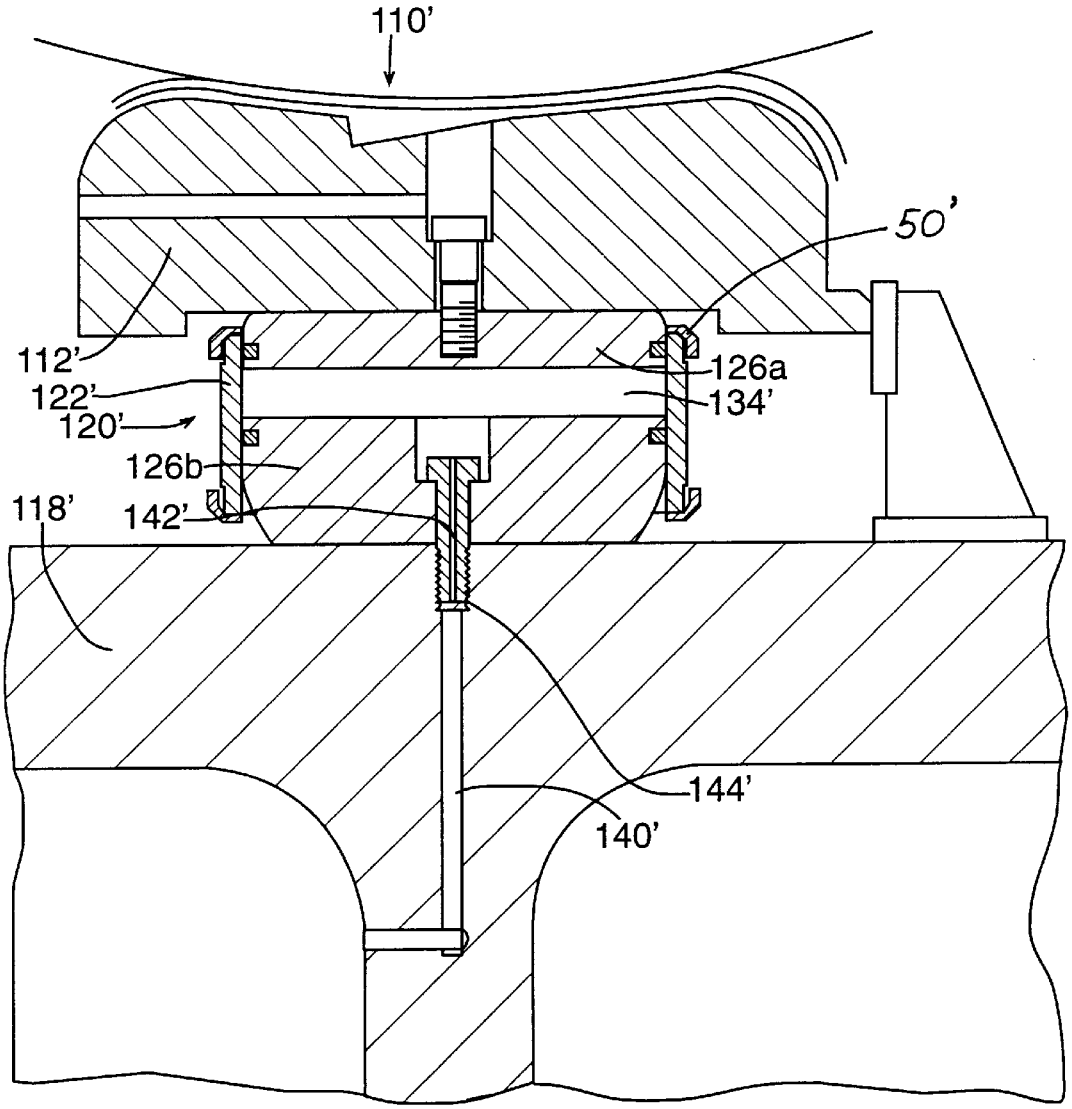
FIG. 6 is a view similar to FIG. 1, showing a fourth preferred embodiment of the invention having two pistons and a common cylinder.

FIG. 6 depicts a fourth preferred embodiment of the invention. The shoe press 110' of FIG. 6 employs loading cylinders 120' in which the two-piece member is the piston and the coupler is the cylinder. Thus, the loading cylinder 120' comprises a first piston **126*a* affixed to the shoe 112', and second piston 126*b* affixed to the support 118', and a cylinder 122' within which both pistons are slidably received. A common working chamber 134' is defined between the pistons 126*a* and 126*b*. Pressurized fluid is supplied to the working chamber 134' by a passage 140' in the support 118' which connects with a passage 142' that extends through a fastener 144' which secures the second piston 126*b* to the support 118'. A ring 50', similar in function to the ring 50 of FIG. 1, is affixed to the end of the cylinder 122' adjacent the shoe 112' for preventing the first piston 126*a* from being withdrawn from the cylinder 122'**.

Figure 7:
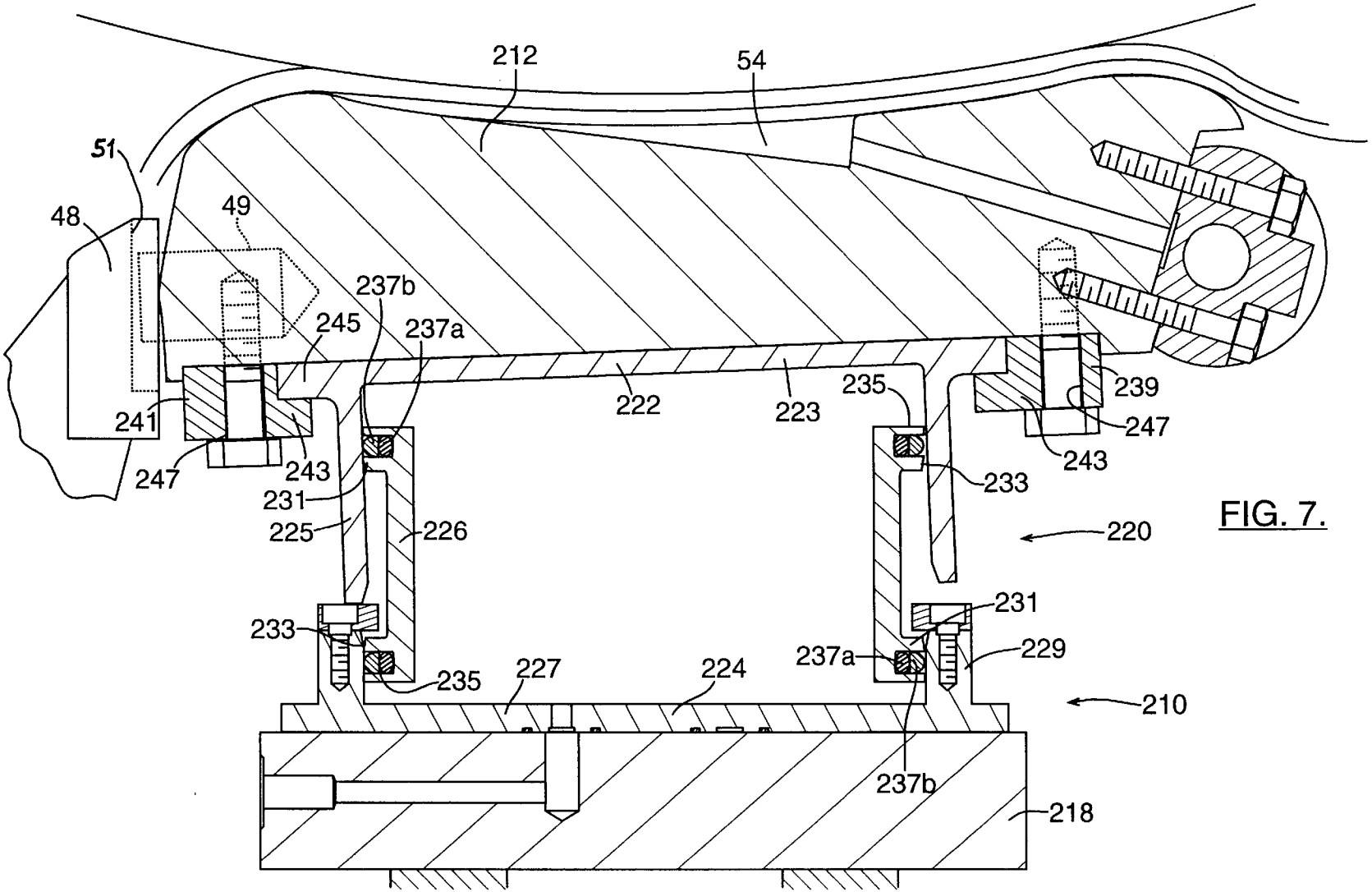
FIG. 7 is a view similar to FIG. 1, showing one of the loading cylinders of a fifth preferred embodiment of the invention.

FIG. 7 depicts a fifth preferred embodiment of the invention. The shoe press 210 of FIG. 7 includes hydraulic loading cylinders 220 in which the pistons 226 are formed as hollow tubular members, and the first cylinder 222 and second cylinder 224 are separate members affixed to the press shoe 212 and the support 218, respectively. The first cylinder 222 has an end wall 223 which abuts the shoe 212 and a hollow tubular portion 225 projecting normally from the end wall 223 toward the second cylinder 224. Similarly, the second cylinder 224 has an end wall 227 which abuts the support 218 and a hollow tubular portion 229 projecting normally from the end wall 227 toward the first cylinder 222. Each of the tubular portions 225 and 229 has a cylindrical inner surface.

The piston 226 includes flanges 231 adjacent each end of the piston. The flanges 231 are generally annular and project radially outward beyond the cylindrical outer surface of the piston. The radially outermost surfaces 233 of the flanges 231 are preferably but not necessarily spherical. Each flange 231 includes a groove 235 continuously encircling the piston and housing a pair of resilient compressible seal rings 237*a* and 237*b*. The inner seal rings 237*a* are preferably rubber or a material having compressibility and resilience properties similar to rubber. The outer seal rings 237*b* which make contact with the inner surfaces of the cylinders are preferably made of a material somewhat stiffer than that of the inner seal rings. A suitable material is, for example, a polymer having bronze additives, although other materials may alternatively be used. The outer seal rings 237*b* project radially outward of the spherical surfaces 233 of the flanges and are larger in diameter than the inner surfaces of the cylinders 222, 224 in their undeformed conditions, such that there is an interference fit of the seal rings in the cylinders. The seal rings 237*a* and 237*b* therefore are compressed, and their resilience keeps them in sealing contact with the cylinders throughout the range of pivotal movement of the piston 226. Additionally, the lengths of the flanges 231 in the radially outward direction are sufficiently large in relation to the axial lengths of the flanges and the axial length between the two flanges so that the piston 226 is capable of pivoting over a relatively large angular range while maintain proper sealing contact of the seal rings 237*b* with the cylinders.

To aid in assembling and disassembling the shoe press, the first cylinders 222 are affixed to the shoe 212 by a pair of clamps 239 and 241 adjacent the upstream and downstream sides, respectively, of the shoe. The clamps include ledges 243 which clamp an annular flange 245 of the first cylinder 222 between the shoe 212 and the ledges 243. It will be noted that the holes 247 in the clamps 239 and 241 through which fasteners are passed for securing the clamps to the shoe are not identically located relative to the ledges 243. This enables the clamps 239 and 241 to be interchanged so as to alter the location of the first cylinder 222 relative to the shoe 212 in the machine direction. Although not shown, the support 218 also includes an adjustment mechanism for moving the support and the second cylinder 224 in the machine direction. This adjustment mechanism may be, for example, a pair of clamps (not shown) similar to the clamps 239 and 241 for securing the support 218 to a frame structure, or alternatively, a pair of such clamps for securing the second cylinder 224 to the support 218. Accordingly, the entire loading cylinder 220 can be shifted in the machine direction relative to the shoe 212 for changing the center of load on the shoe.

Figure 7A:
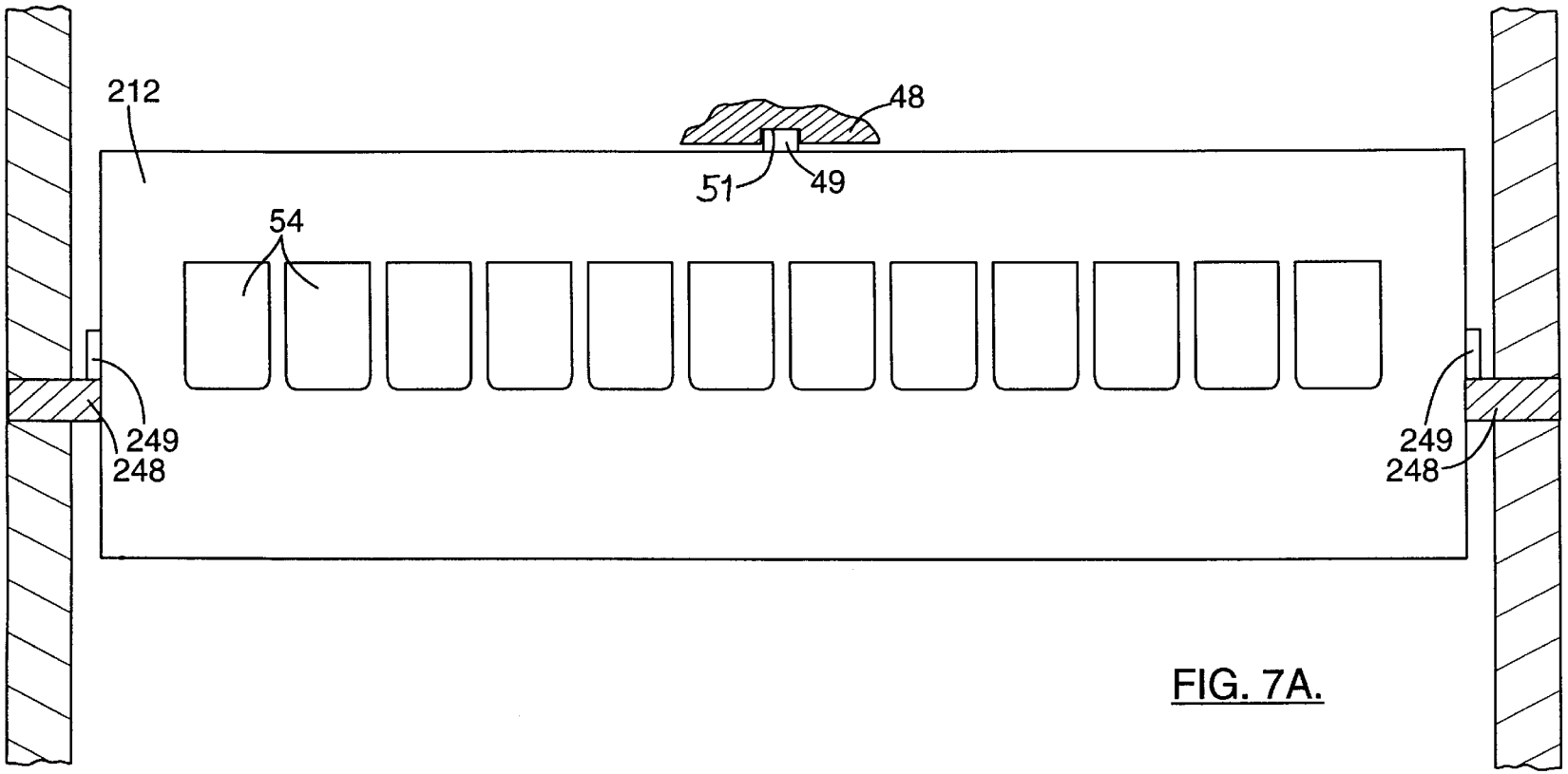
FIG. 7A is a top elevation of the shoe of the shoe press of FIG. 7, showing pins and stops along the side and downstream edges of the shoe for restraining motion of the shoe.

With reference to FIGS. 7 and 7A, the shoe press 210 includes features for limiting motion of the shoe 212 in the upstream, downstream, and cross-machine directions. As previously noted in connection with FIGS. 1 and 2, a stop 48 is positioned adjacent the downstream side of the shoe 212 for limiting the extent of downstream motion of the shoe 212. Additionally, a pin 49 is affixed to the downstream side of the shoe 212 and projects outward therefrom in the machine direction. The stop 48 includes a slot 51 into which the pin 49 extends. The pin 49 is located at a midpoint of the width of the shoe 212 in the cross-machine direction, as shown in FIG. 7A. The slot 51 extends in the loading direction so that the shoe 212 is free to move toward and away from the counter roll. However, the slot 51 is only slightly wider than the pin 49, and accordingly, the shoe 212 is restrained from moving in the cross-machine direction. Furthermore, the pin 49 engaged in the slot 51 ensures that thermal expansion of the shoe 212 in the cross-machine direction does not all occur in a single direction but rather occurs in opposite directions on either side of the longitudinal centerline of the shoe press 210.

The shoe press 210 also includes pins 249 affixed to the opposite side edges of the shoe 212 and projecting outward therefrom in the cross-machine direction. A pair of stops 248 are positioned adjacent the opposite sides of the shoe 212 so that they can be abutted by the pins 249 when the shoe 212 moves in the upstream direction. Thus, the stops 248 and pins 249 limit the extent of shoe movement in the upstream direction, and also help prevent the shoe 212 from assuming a slanted position in which one side is further upstream than the other side. It will of course be appreciated that instead of the stops 248 and pins 249, a single elongate stop (not shown) could be positioned adjacent the upstream edge of the shoe 212 so as to serve the same purposes as the stops 248 and pins 249.

Figure 8:
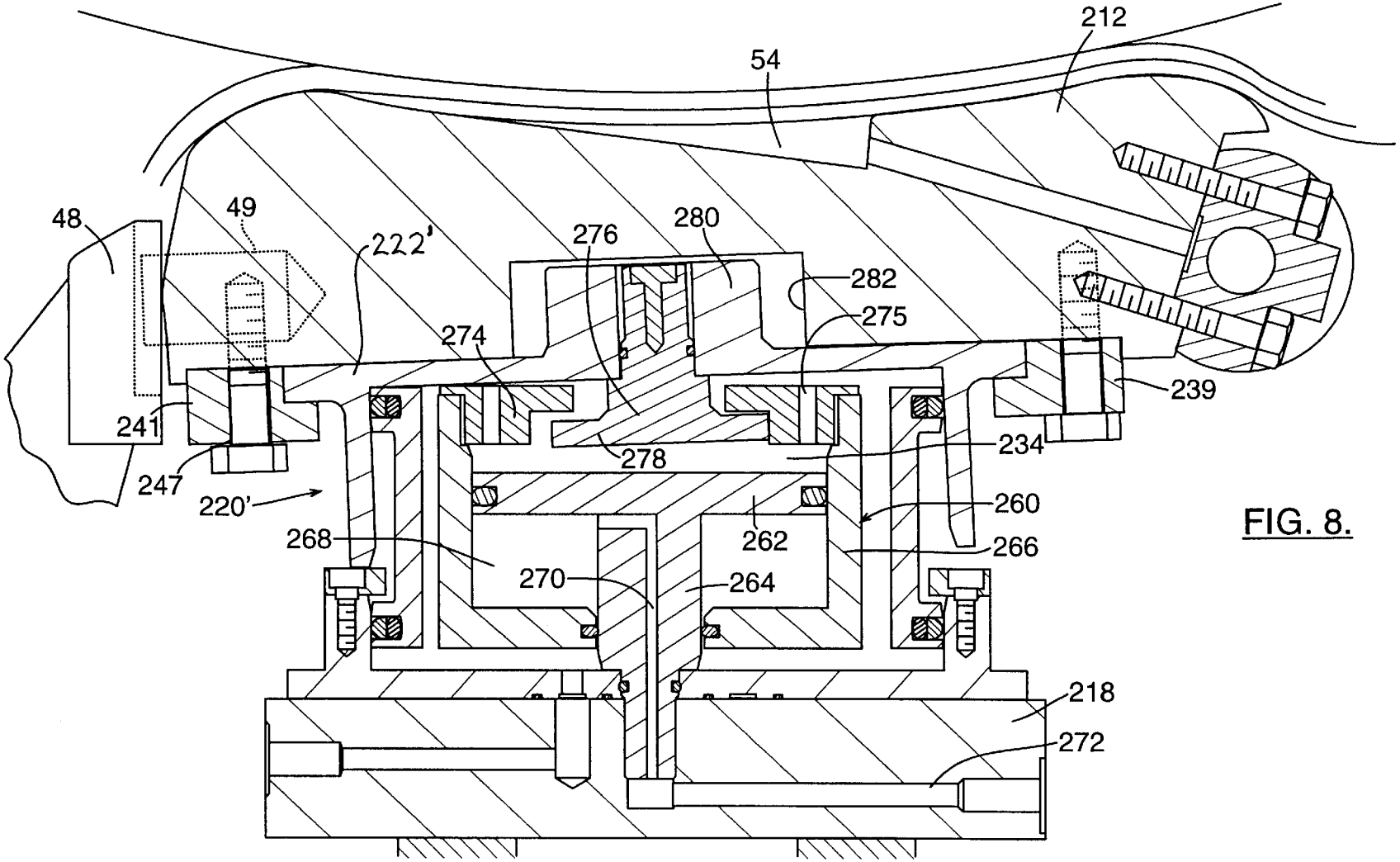
FIG. 8 is a view similar to FIG. 7, showing another of the loading cylinders which includes an internal shoe-retracting actuator within the piston of the loading cylinder.

Preferably, at least one and more preferably several of the loading cylinders of the shoe press 210 include internal shoe-retracting actuators operable to retract the shoe 212 away from the counter roll. FIG. 8 shows one of the loading cylinders 220' having a shoe-retracting actuator 260. The actuator 260 comprises an actuator piston 262 having a stem 264 secured to the support 218 and projecting normally therefrom toward the shoe 212. An actuator cylinder 266 surrounds the actuator piston so as to define a working chamber 268 pressurizable with hydraulic fluid to cause the actuator cylinder 266 to be urged toward the support 218. The stem 264 of the actuator piston includes a passage 270 for supplying fluid into the chamber 268, and the support 218 includes a fluid passage 272 which connects with the passage 270 in the stem. The chamber 268 is constantly pressurized during operation of the shoe press so that the pressure within the chamber 268 of the shoe-retracting actuator is not substantially less than that in the working chamber 234 of the loading cylinder 220' in order to avoid damage to the actuator. When the press shoe 212 is to be retracted away from the counter roll, the pressure in the working chamber 234 is decreased below that in the chamber 268.

The actuator cylinder 266 at the end adjacent the shoe 212 includes an annular ring 274 which extents radially inward from the cylinder side wall. A projection 276 is affixed to the first cylinder 222' and extends through the central opening of the annular ring 274. The projection 276 includes a head 278 larger in diameter than the inner diameter of the ring 274 for engaging the annular ring 274 such that movement of the actuator cylinder 266 toward the support 218 causes the shoe 212 to be pulled toward the support. The annular ring 274 includes holes 275 for equalizing the pressure on both sides of the ring. To aid in disassembling the press, the annular ring 274 is removably threaded into the actuator cylinder 266. The projection 276 is also removably threaded into the first cylinder 222'. The first cylinder 222' includes a reinforced boss 280 into which the projection 276 is threaded. The shoe 212 includes a recess 282 for accommodating the boss 280. The recess 282 is larger in diameter than the boss 280 so that the first cylinder 222' can be shifted in the machine direction by interchanging the clamps 239 and 241, as previously described.

The shoe-retracting actuator 260 also enables a further advantage in addition to its function of retracting the shoe 212. Specifically, if the hydraulic pressure within the chamber 268 of the actuator 260 is reduced below the pressure existing in the working chamber 234, the net loading force exerted on the shoe 212 is increased above that exerted if the pressures are equal in the chambers 234 and 268. Accordingly, the actuator 260 can also be used to increase the loading capacity of a loading cylinder without increasing the size of the loading cylinder.

Figure 9:
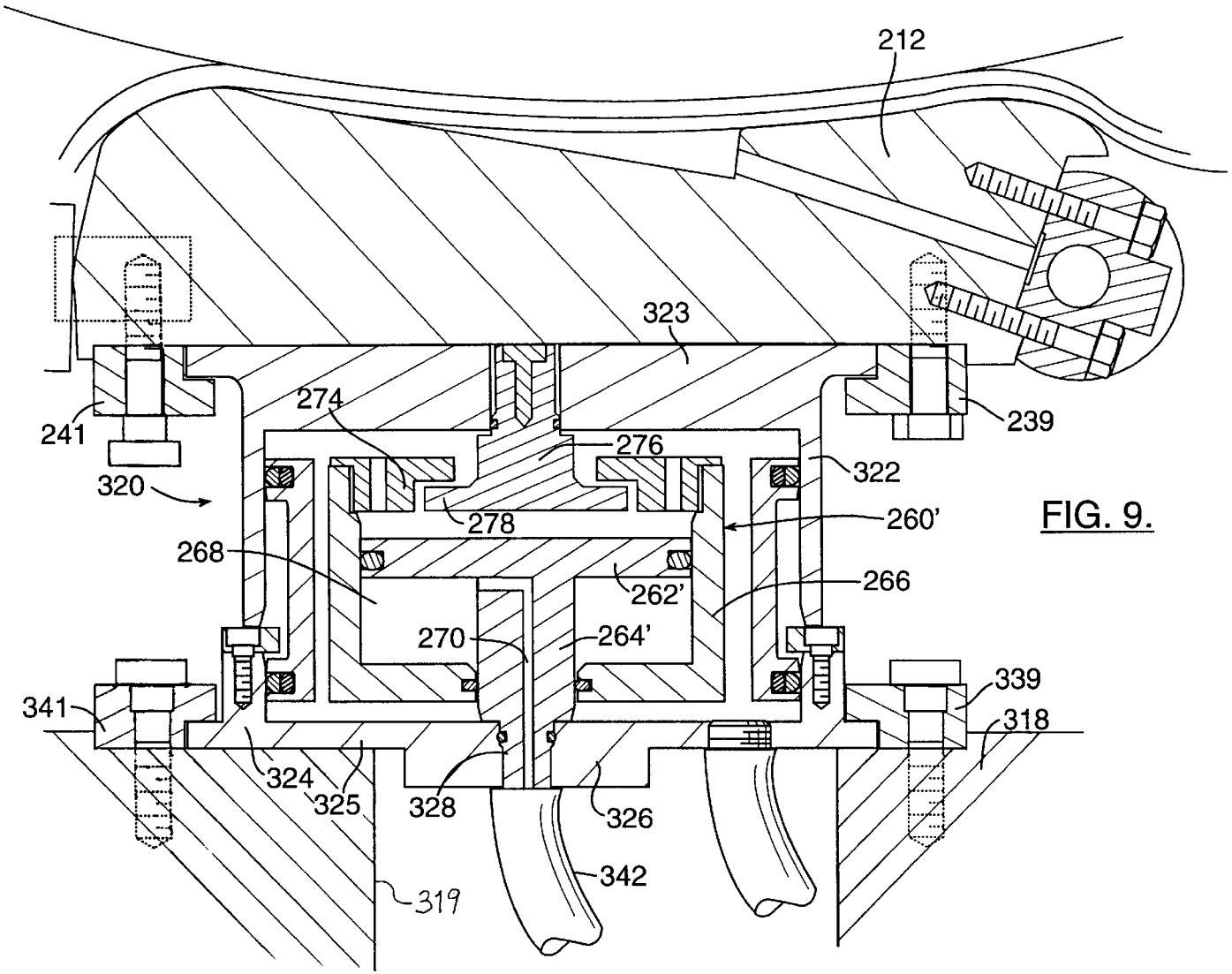
FIG. 9 is a view similar to FIG. 8, showing a loading cylinder in accordance with a sixth preferred embodiment of the invention.

FIG. 9 shows a sixth preferred embodiment of a loading cylinder 320 in accordance with the invention. The loading cylinder 320 includes a first cylinder 322 which has a thickened end wall 323 which mounts the projection 276 of the shoe-retracting actuator 260', and accordingly the shoe 312 does not require a recess for accommodating the projection 276. The first cylinder 322 can be shifted in the machine direction by interchanging the clamps 239 and 241, as described above for the loading cylinder 220' . In addition, the second cylinder 324 can be shifted in the machine direction in a similar manner. To this end, the support 318 includes a recess 319 and the second cylinder 324 includes an end wall 325 upon which the stem 264' of the actuator piston 262' is affixed. The stem 264' extends through a thickened portion 326 of the cylinder end wall 325, and the thickened portion 326 and a part of the stem 264' extend into the recess 319 in the support 318. The recess 319 in the support 318 is wider in the machine direction than the thickened portion 326 of the second cylinder 324 so that the second cylinder 324 can be shifted in the machine direction. The second cylinder 324 is secured on the support 318 by a pair of asymmetric clamps 339' and 341 in similar manner to the attachment of the first cylinder 322 to the shoe 312 by clamps 239 and 241. Thus, the second cylinder 324 is shifted in the machine direction by interchanging the clamps 339 and 341.

Pressurized hydraulic fluid is supplied to the shoe-retracting actuator 260' by a flexible hose 342 which connects to an end 328 of the stem 264' projecting from the thickened portion 326 of the second cylinder end wall 325. This manner of making the fluid connection with the actuator piston 262' facilitates shifting the second cylinder 324 and the actuator 260' in the machine direction.

From the foregoing description of certain preferred embodiments of the invention, it will be appreciated that the invention provides a unique shoe press having significant advantages over prior presses, including the ability to tolerate deformations such as thermal expansion of the shoe without binding or malfunctioning of the loading cylinders. The invention also provides a simple mechanism for adjusting the center of load on the shoe in the machine direction.

Although the preferred embodiments of the invention have been described in considerable detail, the invention is not limited to these embodiments. Various modifications and substitutions of equivalents will readily be comprehended by persons of ordinary skill in the art, and it is intended that such modifications and substitutions be encompassed within the scope of the invention as set forth in the appended claims.

What is claimed is:

1. A shoe press for applying pressure to a web which is carried in a machine direction through a nip between the shoe press and a backing member, comprising:

a press shoe adapted to be juxtaposed with the backing member such that the web can be carried through the nip defined therebetween, the press shoe extending in a cross-machine direction along substantially a full width of the web;

a support which supports the press shoe such that the press shoe is movable in a loading direction toward the backing member for applying pressure to the web;

a plurality of articulated hydraulic loading cylinders spaced apart in the cross-machine direction along the press shoe, each loading cylinder including a piston member disposed within a cylinder member so as to define a working chamber pressurizable by hydraulic fluid, one of the piston and cylinder members comprising a two-piece member having a first member fixed relative to the press shoe and a second member fixed relative to the support and spaced from the first member, and the other of the piston and cylinder members comprising a coupler sealingly engaging both the first and second members such that the first member is urged away from the second member in a loading direction by pressurization of the working chamber to cause the press shoe to be urged toward the backing member;

each coupler engaging the respective first and second members at seals which enable the coupler to pivot relative to the first and second members about axes parallel to the machine direction, whereby the articulated hydraulic loading cylinders enable the press shoe to move in the cross-machine direction relative to the support.

2. The shoe press of claim 1, wherein the two-piece member comprises separately formed first and second cylinders fixed relative to the press shoe and support, respectively, and wherein the coupler comprises a piston, the piston including a first end received within the first cylinder and a second end received within the second cylinder.

3. The shoe press of claim 1, wherein the loading cylinders are arranged in two rows which are spaced apart in the machine direction, the loading cylinders in one of the rows being hydraulically pressurizable independently of the loading cylinders in the other row such that nip pressure can be varied in the machine direction.

4. The shoe press of claim 1, wherein the coupler comprises a cylinder and the two-piece member comprises a first piston fixed relative to the press shoe and a second piston fixed relative to the support, the cylinder sealingly surrounding both pistons so as to define a common working chamber between the pistons.

5. The shoe press of claim 1, further comprising an adjustable fastening mechanism which secures the first member to the shoe, the fastening mechanism being operable to adjust the location of the first member relative to the shoe in the machine direction.

6. The shoe press of claim 2, wherein the first end of the piston and the first cylinder define a first working chamber therebetween, and the second end of the piston and the second cylinder define a second working chamber therebetween, each of the working chambers being pressurizable with hydraulic fluid.

7. The shoe press of claim 2, wherein the piston includes spherical surfaces for allowing the piston to pivot relative to both the first and second cylinders.

8. The shoe press of claim 2, wherein the first and second ends of the piston each supports a resilient compressible seal encircling the piston for sealing against an inner surface of the corresponding cylinder.

9. The shoe press of claim 2, wherein each of the pistons is tubular so as to define an open interior therein, and further comprising a hydraulically operated shoe-retracting actuator disposed within the interior of at least one of the pistons, the actuator being operable by hydraulic pressure to urge the shoe away from the counter roll.

10. The shoe press of claim 6, wherein the piston includes a passage connecting the first working chamber with the second working chamber to permit fluid communication therebetween.

11. The shoe press of claim 10, wherein one of the press shoe and the support includes a supply passage therein for supplying pressurized hydraulic fluid into one of the first and second working chambers.

12. The shoe press of claim 11, wherein the supply passage is in the support.

13. The shoe press of claim 8, wherein the piston comprises a tubular member having generally cylindrical inner and outer surfaces, each of the first and second ends of the piston having an annular flange which projects radially outward beyond the cylindrical outer surface of the piston, each flange supporting one of the resilient compressible seals.

14. The shoe press of claim 9, wherein the shoe-retracting actuator comprises an actuator piston attached to the support and extending into the interior of the piston of the loading cylinder, and an actuator cylinder sealingly surrounding the actuator piston so as to define a chamber pressurizable by hydraulic fluid to urge the actuator cylinder toward the support, the actuator cylinder engaging a projection affixed to the press shoe such that actuation of the shoe-retracting actuator causes the press shoe to be urged toward the support.

15. The shoe press of claim 14, wherein the actuator piston includes a stem attached to the support and projecting normally therefrom toward the press shoe, the stem including a passage which opens into the chamber in the shoe-retracting actuator, the support having a hydraulic fluid supply passage which connects with the passage in the stem.

16. The shoe press of claim 13, wherein the first and second cylinders comprise cup-shaped members each having an end wall affixed to the press shoe and support, respectively, and a tubular portion connected to the end wall and extending toward the other cylinder, each of the tubular portions defining a cylindrical inner surface which is sealingly engaged by one of the seals on the piston.

17. The shoe press of claim 16, wherein the tubular portion of the second cylinder includes a stop member which extends radially inward to a diameter smaller than the flange on the second end of the piston so as to limit movement of the piston in the loading direction away from the support.

18. A shoe press for applying pressure to a web which is carried in a machine direction through a nip defined between the shoe press and a backing member, comprising:

a press shoe adapted to be juxtaposed with the backing member so as to form the nip between the backing member and the press shoe, the press shoe extending in a cross-machine direction along a width of the web;

a support providing support for the press shoe;

an articulated hydraulic loading cylinder including a floating piston and first and second cylinders arranged between the support and the press shoe, the loading cylinder including separately formed first and second cylinders, the first cylinder fixed relative to the press shoe and the second cylinder fixed relative to the support, the floating piston having opposite first and second end portions slidably received within and sealingly engaging the first and second cylinders so as to define first and second working chambers pressurizable by hydraulic fluid for urging the first and second cylinders away from each other in a loading direction to urge the press shoe toward the backing member;

the piston being a tubular member having generally cylindrical inner and outer surfaces, each of the first and second end portions of the piston having an annular flange which projects radially outward beyond the cylindrical outer surface of the piston, each flange supporting a resilient compressible seal which engages an inner surface of the respective cylinder, the flanges accommodating pivoting of the piston relative to the cylinders about axes parallel to the machine direction.

19. The shoe press of claim 18, wherein the first cylinder comprises a recess formed in the press shoe.

20. The shoe press of claim 18, wherein the first cylinder is formed separately from the press shoe and is affixed to the press shoe.

21. The shoe press of claim 18, wherein the second cylinder is formed separately from the support and is affixed to the support.

22. The shoe press of claim 18, further comprising a stop ring affixed to the second cylinder and accepted to engage the flange on the second end portion of the piston for limiting movement of the piston away from the support.

23. The shoe press of claim 18, wherein each of the flanges has spherical surfaces confronting the inner surface of the respective cylinder to facilitate pivoting of the piston within the cylinder.

24. The shoe press of claim 18, further comprising a hydraulically operated shoe-retracting actuator disposed within the interior of the piston, the actuator being operable by hydraulic pressure to urge the shoe toward the support so as to limit movement of the shoe away from the support.

25. The shoe press of claim 20, further comprising an adjustable fastening mechanism which secures the first cylinder to the shoe, the fastening mechanism being operable to adjust the location of the first cylinder relative to the shoe in the machine direction.

26. The shoe press of claim 24, wherein the shoe-retracting actuator comprises an actuator piston attached to the support and extending into the interior of the piston of the loading cylinder, and an actuator cylinder sealingly surrounding the actuator piston so as to define a chamber pressurizable by hydraulic fluid to urge the actuator cylinder toward the support, the actuator cylinder engaging a projection affixed to the press shoe such that actuation of the shoe-retracting actuator causes the press shoe to be urged toward the support.

27. The shoe press of claim 26, wherein the actuator piston includes a stem attached to the support and projecting normally therefrom toward the press shoe, the stem including a passage which opens into the chamber in the shoe-retracting actuator, the support having a hydraulic fluid supply passage which connects with the passage in the stem.

28. The shoe press of claim 25, wherein the fastening mechanism comprises clamps which clamp the first cylinder onto the shoe, the clamps being locatable in multiple positions on the shoe for adjusting the location of the first cylinder on the shoe.

29. The shoe press of claim 28, further comprising a second adjustable fastening mechanism for securing the second cylinder to the support, the second adjustable fastening mechanism comprising clamps adapted to clamp the second cylinder onto the support in multiple positions thereon for adjusting the location of the second cylinder in the machine direction.

* * * * *